US011445864B2

(12) United States Patent
Smith

(10) Patent No.: US 11,445,864 B2
(45) Date of Patent: Sep. 20, 2022

(54) SHOWER WALL UPRIGHT SOAP CASE

(71) Applicant: Tijuana Smith, Hinsdale, IL (US)

(72) Inventor: Tijuana Smith, Hinsdale, IL (US)

(73) Assignee: Tijuana Smith, Hinsdale, IL (US)

( * ) Notice: Subject to any disclaimer, the term of this patent is extended or adjusted under 35 U.S.C. 154(b) by 0 days.

(21) Appl. No.: 16/909,923

(22) Filed: Jun. 23, 2020

(65) Prior Publication Data

US 2020/0329922 A1 Oct. 22, 2020

Related U.S. Application Data

(63) Continuation-in-part of application No. 15/933,340, filed on Mar. 22, 2018, now abandoned.

(51) Int. Cl.
*A47K 5/02* (2006.01)
*A47K 5/05* (2006.01)

(52) U.S. Cl.
CPC . *A47K 5/02* (2013.01); *A47K 5/05* (2013.01)

(58) Field of Classification Search
CPC ..... A47B 46/005; A47K 5/02; A47K 5/05; A47K 3/281; A47K 2201/02; A47G 29/087; E05C 19/02; E05C 19/022; E05C 19/06
See application file for complete search history.

(56) References Cited

U.S. PATENT DOCUMENTS 2,618,884 A * 11/1952 Low ..... A47K 5/02 312/242
2,974,839 A * 3/1961 Batlas ..... A47K 10/3687 225/12
3,054,212 A * 9/1962 Morris ..... A47K 5/02 312/351
4,300,248 A * 11/1981 Dworkin ..... A47K 5/05 248/27.3
4,444,359 A * 4/1984 Butler ..... A47K 10/38 225/51
D283,576 S * 4/1986 Lambert ..... D6/540
D298,712 S * 11/1988 Mattei ..... D6/551
5,761,752 A * 6/1998 Blake ..... A47K 3/281 4/559
6,382,553 B1 * 5/2002 Lewis ..... A47K 10/38 242/594.4
D553,820 S * 10/2007 Baumgart ..... D32/58
7,407,237 B2 * 8/2008 Bright ..... A47B 67/02 312/242
9,950,615 B2 * 4/2018 Horikawa ..... E05C 19/022
10,561,283 B2 * 2/2020 Deng ..... A47K 10/3836
2012/0068587 A1 * 3/2012 Pantoja ..... A47K 3/281 312/242

* cited by examiner

*Primary Examiner* — Ko H Chan

(57) ABSTRACT

A shower wall upright soap holder with a recessed soap case, a collapsible soap holster and a drip tray. The recessed soap case can be mounted in a wall. The collapsible soap holster is attached to the recessed soap tray and can hold a bar of soap in a standing position. The collapsible soap holster may transition between an open and a closed holster configuration by application of push-to-open force that may engage and disengage a push-to-open latch. The drip tray can sit underneath the soap holster and may transition between a closed drip tray configuration and an open drip tray configuration by application of a push-to-open force that engages and disengages a push-to-open latch.

20 Claims, 15 Drawing Sheets

SHOWER WALL UPRIGHT SOAP CASE

CROSS-REFERENCE TO RELATED APPLICATIONS

This is a Continuation In Part of application Ser. No. 15/933,340.

FIELD OF THE INVENTION

The present disclosure relates to shower soap cases used to hold soap between uses. More specifically, the present disclosure relates to a collapsible shower wall soap holding device that can be installed in a bath or shower wall and holds in a standing position handmade soap as well as other soaps sold by commercial retailers.

BACKGROUND

An increased number of consumers have switched from using bar soap to liquid soap. Many are turned off by the gooky waste that is collected from soap holding apparatuses when soap is place in them between uses. This is particularly a problem for consumers who use all-natural handmade soap. With the increase among consumers for natural products, handmade soap makers are experiencing an increase in demand for their products. Handmade soap is larger and shaped differently than traditional soaps sold on the market. A traditional bar of soap may be 1"×2"×3.75" or often smaller. Handmade soap may be 1"×3"×4". Seeing that handmade soaps are not sold in grocery store chains or department stores, options are limited for storing the soap between uses.

Handmade soap makers have either resorted to making their own packaging or just wrapping it in regular paper. In addition to that, the soap doesn't fit very well into the traditional soap cases/dishes sold in stores. They are either stored in loofah soap pouches or wrapped up in paper or plastic. This decreases the amount of uses a customer will get out of that soap because the soap needs air to dry and keep it from dissolving or melting away. Soap cases/dishes on the market are made to have the soap lay on the dish. In between washes, the water drains from the soap and the soap is laying in the bacteria from the water causing it to quickly dissolve from laying in the excess water. None of the soap holders provide a way for the soap to be able to stand instead of laying on the dish and none of them are designed in a way that allows the excess water to drain out while the soap is in the holder.

A need exists in the field for a soap hosting apparatus that will accept a range of different sized soaps including handmade soap. The soap will be positioned on the collapsible holster standing upright instead of laying. The collapsible soap holster has a hole on each arm that clamps into the recessed soap case. There is also a drip tray below to catch the water that drains from the soap. A further need exists for this apparatus to collapse and fold into the recessed soap case to keep the soap from falling when wet and slippery. Finally, there is also a need for the configuration of additional apparatuses to accommodate the dimensions of other soap molds and sizes.

BRIEF SUMMARY OF THE INVENTION

The present invention comprises a recessed soap case with pins that the collapsible soap holster clamps into that rest on a drip tray which is in place to catch the excess water that drips from the soap when it has been used. The hosting device is configured in different sizes to accommodate different shapes and molds of soap.

The recessed soap case can be mounted in a wall. The collapsible soap holster is attached to the recessed soap tray and can hold a bar of soap in a standing position. The collapsible soap holster may transition between an open and a closed holster configuration by application of push-to-open force that engage and disengage a push-to-open latch. The drip tray can sit underneath the soap holster and may transition between a closed drip tray configuration and an open drip tray configuration by application of a push-to-open force that engages and disengages a push-to-open latch.

BRIEF DESCRIPTION OF THE DRAWINGS

Some embodiments of the present invention are illustrated as an example and are not limited by the figures of the accompanying drawings, in which like references may indicate similar elements and in which.

Figure 1A:
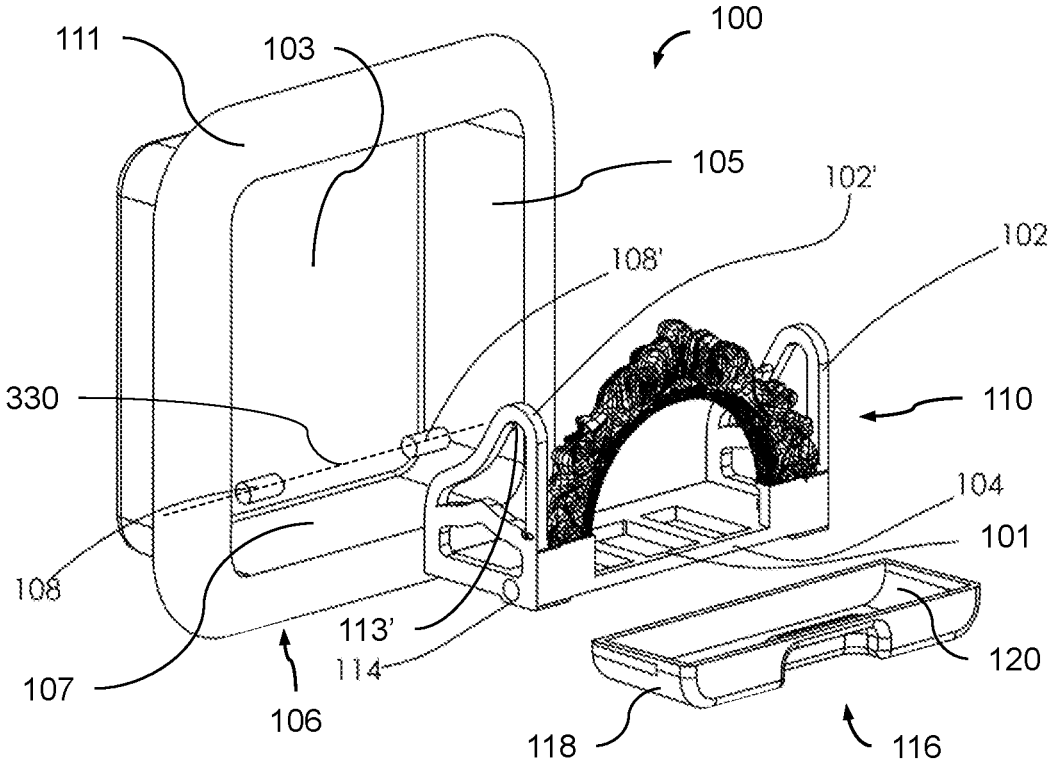
FIG. 1A depicts an exploded view of one example of a shower wall upright soap case.

It should be noted that the accompanying figures are intended to present illustrations of example embodiments of the present disclosure. The figures are not intended to limit the scope of the present disclosure. It should also be noted that accompanying figures are not necessarily drawn to scale.

DETAILED DESCRIPTION OF THE INVENTION

The terminology used herein is for the purpose of describing particular embodiments only and is not intended to be limiting of the invention. As used herein, the term "and/or" includes any or all combinations of one or more of the associated listed terms. As used herein, the singular forms "a," "an, "and "the" are intended to include the plural forms as well as the singular forms, unless the context clearly indicates otherwise. It will be further understood the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New soap hosting devices, apparatuses, and methods for positioning soap in a standing position on top of a dish and operating a push-to-open shower wall upright soap holder are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by referencing the appended figures representing preferred embodiments.

FIG. 1A depicts an exploded view of one example of a shower wall upright soap holder (a "device") 100. The elements of the device 100 include a recessed soap case 106, a collapsible soap holster 110 and a drip tray 116.

Figure 2A:
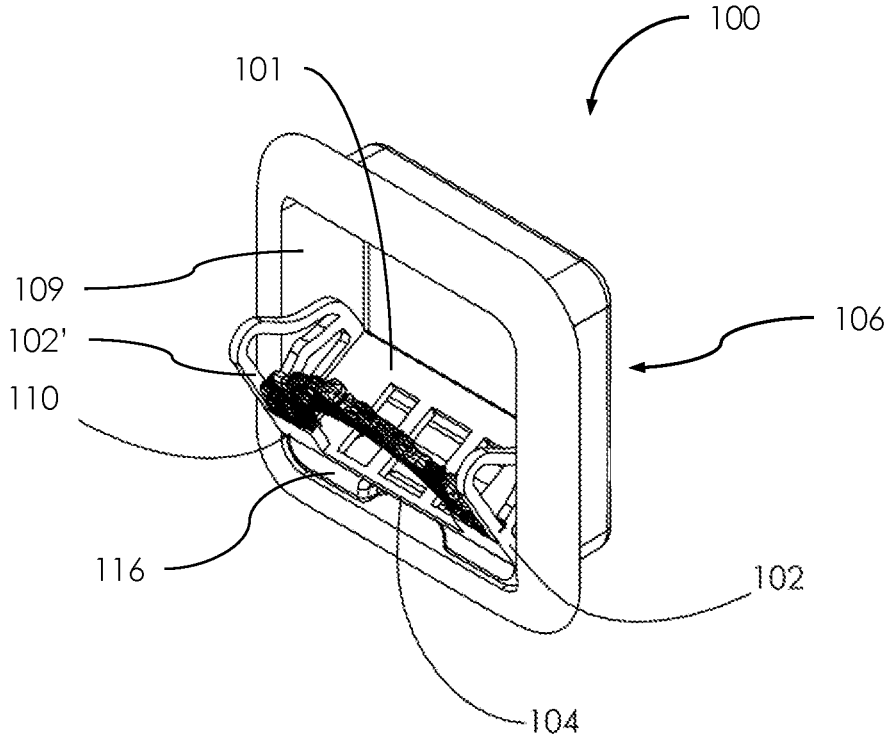
FIGS. 2A, 2B, 2C and 2D depicts various views of the shower wall upright soap holder.
Figure 2B:
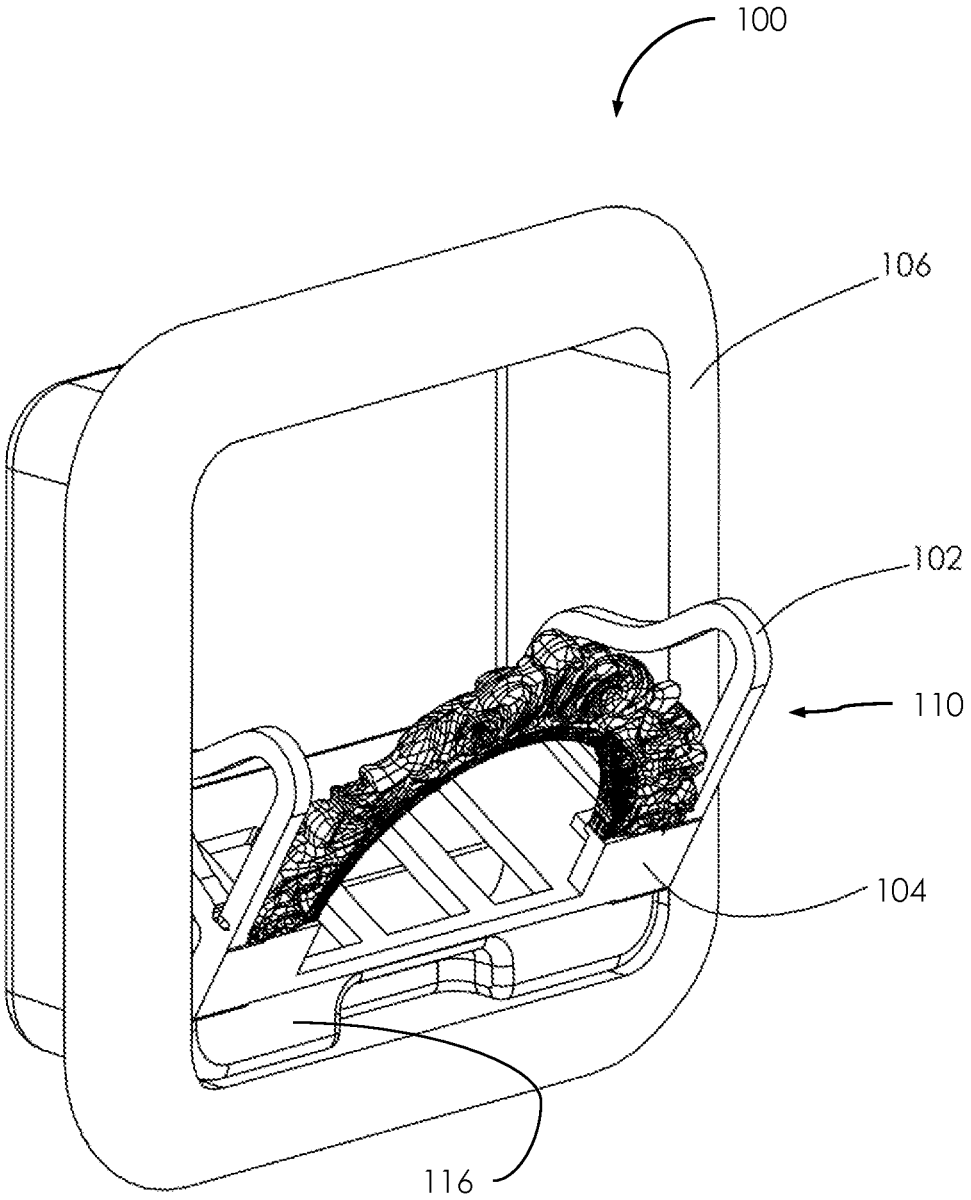
Figure 2C:
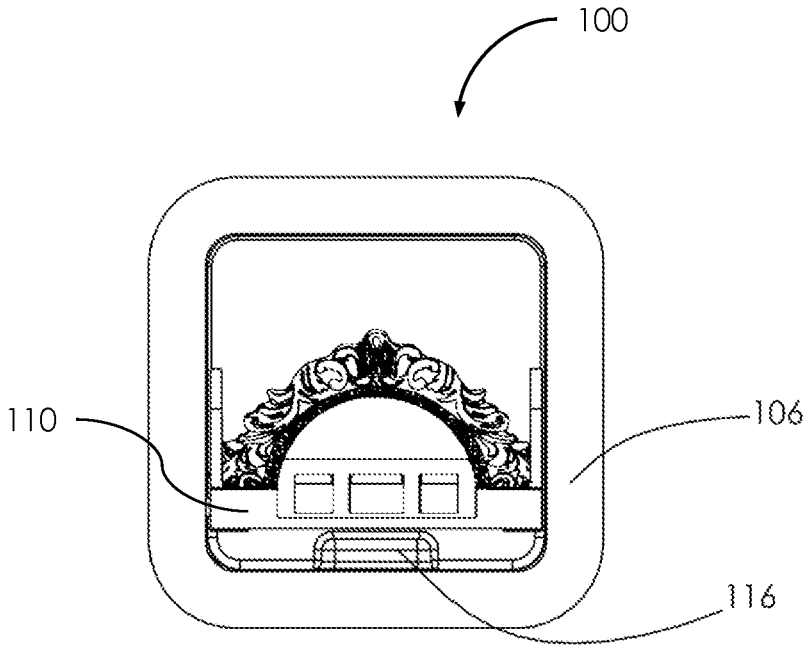
Figure 2D:
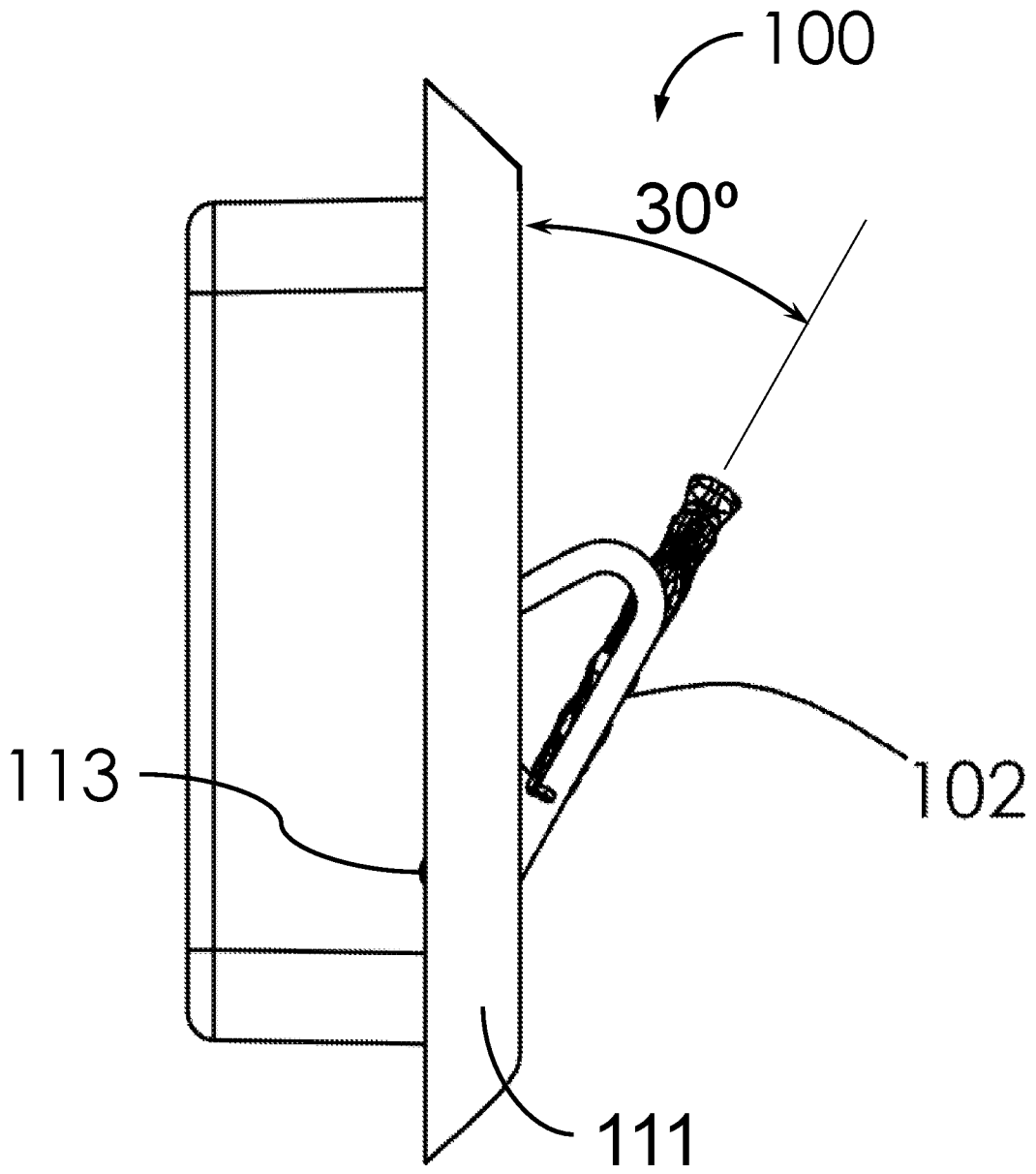

The recessed soap case 106 has a soap case back 103, a right soap case wall 105 and an inside bottom surface 107 in the right soap case wall 105 with a hole 113', the inside left surface 109 (shown in FIG. 2A) with a hole 113 (shown in FIG. 2D). Where the holes 113 and 113' make a soap holder rotation axis 330.

The collapsible soap holster 110 that has a holster bottom 101, two side arms (a right side arm 102 and a left side arm 102') with a front bracket 104 attached on the front of the right side arm 102 and the front of the left side arm 102', where the front bracket 104 serves as a front retainer for a bar of soap. The holster bottom 101, the right side arm 102 and left side arm 102' and the front bracket 104 create a space for a bar of soap. The space may be 4.1" wide 3.75" high and 1.5" deep. The space may be bigger or smaller than these dimensions. The front bracket 104 is shown with a single arch that has a decorative sculptured design.

The drip tray 116 is shown located under the collapsible soap holster 110. The drip tray 116 slides under the collapsible soap holster 110 and can catch the excess water that drips from the soap. The drip tray 116 rests on the inside bottom surface 107 of the recessed soap case 106. The drip tray 116 is generally rectangular shaped with the longer side running left to right and the short side running front the back. The bottom left edge 118 of the drip tray 116 and bottom right edge 120 of the drip tray 116 are rounded to match the contour of the front rim 111. The drip tray 116 is not as deep as the collapsible soap holster 110 so the drip tray 116 can be behind the front of the holster 110 as front of the holster pivots forward and the front bows down.

Figure 1B:
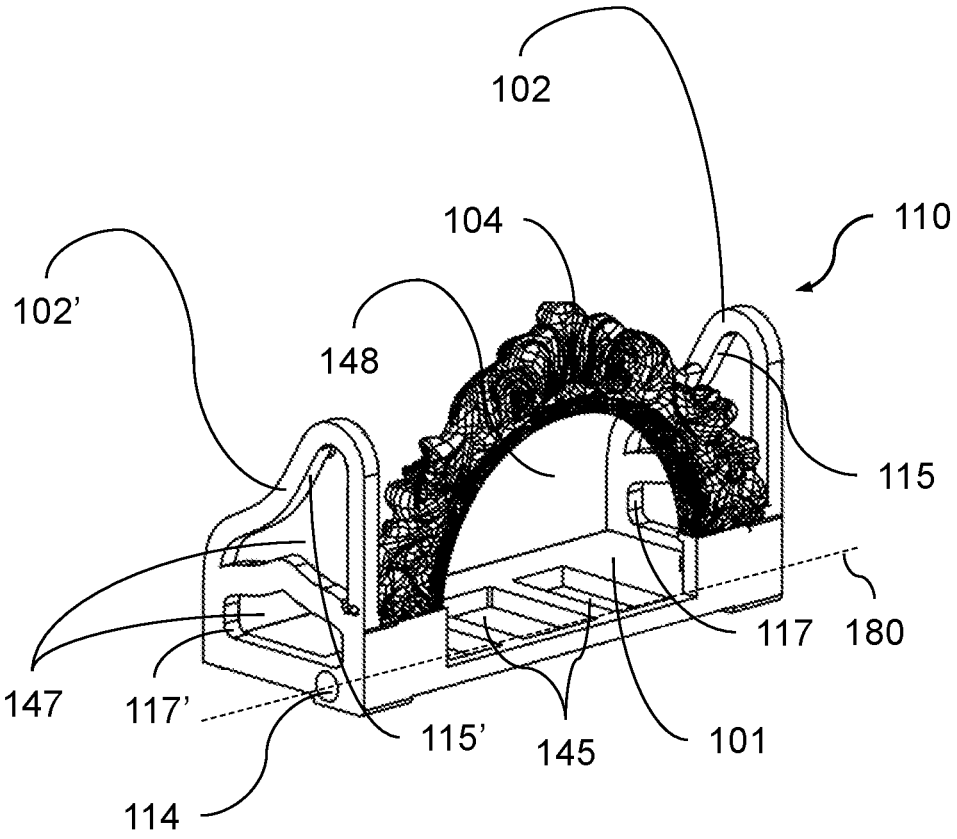
FIG. 1B depict a perspective view of a collapsible soap holster.

FIG. 1B depict a perspective view of the collapsible soap holster 110. The right side arm 102 has a right upper enclosed opening 115 and an enclosed right bottom opening 117. These openings allow the soap to air dry. The right upper opening 115 has a RU rear edge, a RU top edge, a RU front edge, and a RU bottom edge. The RU rear edge, RU top edge and RU front edge of the right upper enclosed opening 115 are contoured to follow the outside shape of the right side arm 102. The RU bottom edge of the right upper enclosed opening 115 shares a contour with the right bottom opening 117. The right bottom opening 117 has a RB rear edge, a RB top edge, a RB front edge, and a RB bottom edge. The RB back edge, RB bottom edge and RB front edge of the right bottom opening 117 are contoured to follow the outside shape of the right side arm 102.

The left side arm 102' has an enclosed left upper opening 115' and an enclosed left lower opening 117'. These openings allow the soap to air dry. The left upper enclosed opening 115' is enclosed with a LU rear edge, a LU top edge, a LU front edge, and a LU bottom edge. The LU rear edge, LU top edge and LU front edge of the left upper enclosed opening 115' are contoured to follow the outside shape of the left side arm 102'. The LU bottom edge of the left upper enclosed opening 115' shares a contour edge with the left bottom enclosed opening 116'. The left bottom opening 116' has a LB rear edge, a LB top edge, a LB front edge, and a LB bottom edge. The LB back edge, LB bottom edge and LB front edge are contoured to follow the outside shape of the left side arm 102'.

The collapsible soap holster 110 may hold a bar of soap in a standing position and prevents it from sliding out on the side and touching the recessed soap case 106. The collapsible soap holster 110 has a pair of holster holes 114, one on each arm (left side arm 102' and right side arm 102) that can clamp onto the pins (left pin 108 and right pin 108'). The holster holes 114 are coaxial. The pins 108 and 108' may fit inside the pair of holster holes 114 enabling angular motion of the collapsible soap holster 110 on a holster rotation axis 180. The pins 108 and 108' may be mounted in the inside left surface 109 and the inside right soap case wall 105 of the recessed soap case 106. Alternatively, the recessed soap case 106 may have a pair of holes 113 and 113' and the collapsible soap holster 110 may have coaxial pins. In general, the shape and the location of holes and pins may vary so long as angular motion of collapsible soap holster 110 is enabled. Other mechanisms may be used to replace pin-holes combination with equivalent mechanisms that allow the collapsible soap holster 110 to pivot.

On the collapsible soap holster 110 the front bracket 104 may have one or more front openings 148. The holster bottom 101 may have one or more bottom openings 145. The side holder surfaces may have one or more side openings 147. The one or more openings 145, 147 and 148 may leave open 40%, 60%, 80% or more of the holster bottom 101, the side arms 102 and 102' and the front bracket 104 open for air flow. The holster bottom 101 may have one, two or more rails running from front to back to support the bar of soap. The side of the soap holster may have curved rails to contain the soap. The rails may be skinny rails. The rails may be ¼", 3/16", ⅛" or less the ⅛".

By holding the bar of soap in the standing position, water may better drip off and the openings 145, 147 and 148 allows the air to freely circulate around the bar of soap to facilitate drying and hardening of the bar of soap thus extending the useful life of the soap.

FIG. 2A depicts a top right perspective view of the shower wall upright soap holder 100 in an open holster configuration. The bottom of the collapsible soap holster 110 sits inside the recessed soap case 106 and the collapsible soap holster 110 is tipped forward out of the recessed soap case 106 to a predefined angle. Tipping of the collapsible soap holster 110 beyond the predefined angle may be restricted by the front top edge of the drip tray 116. Alternatively there may be a gap between the collapsible soap holster 110 and the drip tray 116 that allows the collapsible soap holster 110 to freely rotate forward and stopping at the predetermined angle is determined by other means for example catches that stop the side arms 102 and 102' from moving further forward. The inside left surface 109 is visible on the recessed soap case. The collapsible soap holster 110 has the holster bottom 101, the right side arm 102, left side arm 102', and the front bracket 104. Also shown is the drip tray 116 in the recessed soap case 106 resting on the inside bottom surface 107, positioned under the collapsible soap holster 110.

FIG. 2B depicts a left upper perspective view of the shower wall upright soap holder 100 in the open holster configuration with the recessed soap case 106, the collapsible soap holster 110 and the drip tray 116. The right side arm 102 and the front bracket 104 of the collapsible soap holster 110 can be seen.

FIG. 2C depicts a front view of the shower wall upright soap holder 100 in the open holster configuration. The shower wall upright soap holder 100 has the recessed soap case 106 the collapsible soap holster 110 and the drip tray 116.

FIG. 2D depicts a left side view of the shower wall upright soap holder 100 in the open holster configuration. The collapsible soap holster 110 is shown in the open holster configuration with the collapsible soap holster 110 tipped opened to an angle of 30 degrees. The collapsible soap holster 110 may be tipped opened to any other angle as well without impacting the scope of the disclosure. Also, slightly visible is the right hole 113, the view of which is mostly covered by the front rim 111.

Figure 3A:
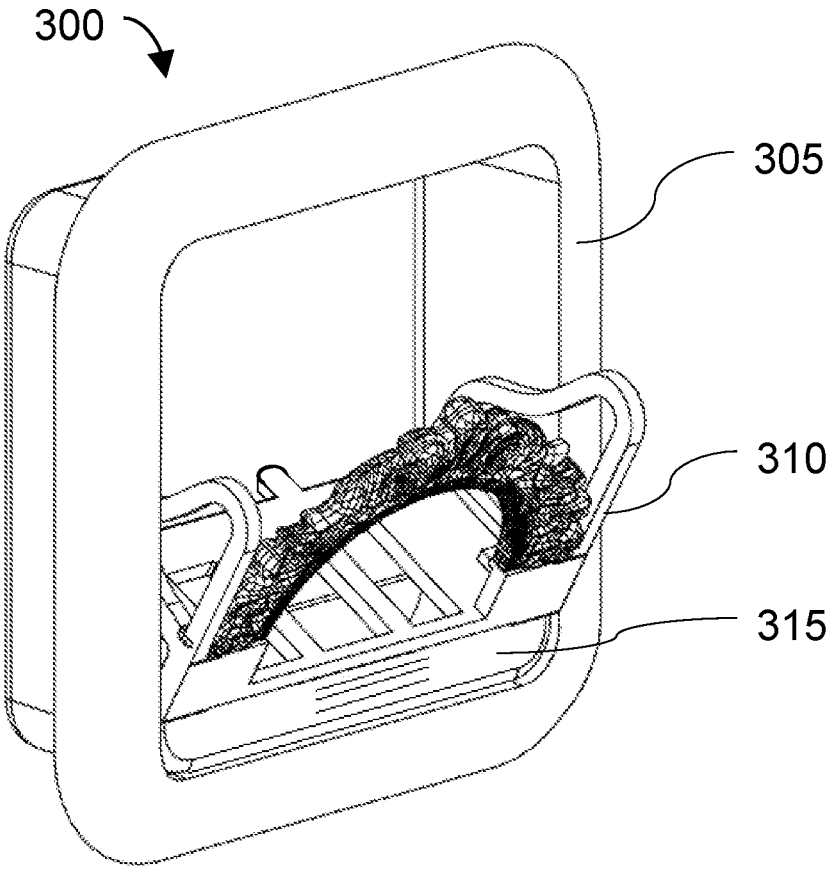
FIG. 3A depicts a top left perspective view of a push-to-open shower wall upright soap holder in an open holster configuration.

FIG. 3A depicts a perspective view of a push-to-open shower wall upright soap holder 300 in the open holster configuration with a push-to-open recessed soap case 305, a push-to-open collapsible soap holster 310 and a push-to-open drip tray 315.

The push-to-open shower wall upright soap holder 300 may only have the push-to-open recessed soap case 305 with the push-to-open collapsible soap holster 310. Water dripping off the bar of soap could land the inside bottom surface 107 and those drips may be directed out the front of the push-to-open recessed soap case 305. For example, the inside bottom surface 107 may have a slight forward tilt to direct the water out.

Figure 3B:
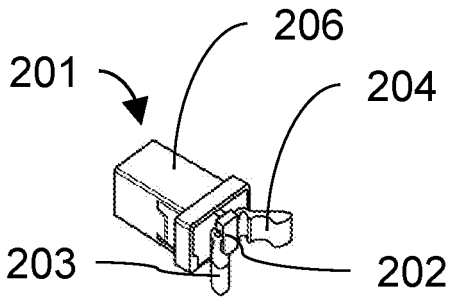
FIG. 3B illustrates a push-to-open latch.

FIG. 3B illustrates a push-to-open latch 201 with a plunger 202, a left clasp arm 203 and a right clasp arm 204. When a pusher with a ball or bulb at the end is pushed against plunger 202, the clasps arms 203 and 204 close to hold onto the bulb. Pushed again, the clasps arms 203 and 204 open to allow the pusher with bulb to move freely.

When the plunger 202 is pushed with a pusher it will begin to travel into in body 206 of the push-to-open latch 201. As the plunger travels the left clasp arm 203 and the right clasp arm 204 will swing into a closed position. In the closed position the clasp arms 203 and 204, create a narrower gap between the ends of the clasp arms 203 and 204 that can hold onto what has pushed the plunger, if the pusher has a corresponding narrow portion. For example, the pusher that engages the plunger 202 could be an extended cylinder with a ball or bulb shaped head. As the plunger 202 continues into the body 206 it will pass a catch position at which point when the pusher stops pushing the plunger may move out slightly but will stop in a catch position, with the clasp arms 203 and 204 in a closed position. The latch will stay in this position holding any bulb on the pusher. If the pusher is pushed on again then the plunger 202 can travel into the body 206 until it passes a release point. After passing the release point then when the pusher stops pushing the plunger can travel out of the body 206 going past the catch point so the clasp arms 203 and 204 open up again then any bulb on the plunger is free from constraint and can be removed from the latch.

In this document the push-to-open latch 201 may have other construction or functions that allow transition from an open configuration to a closed configuration, for example instead of the push-to-release latch having a mechanical clasps arms 203 and 204, magnets could be used, or the push to release mechanism could be integral to the collapsible soap holster.

Figure 3C:
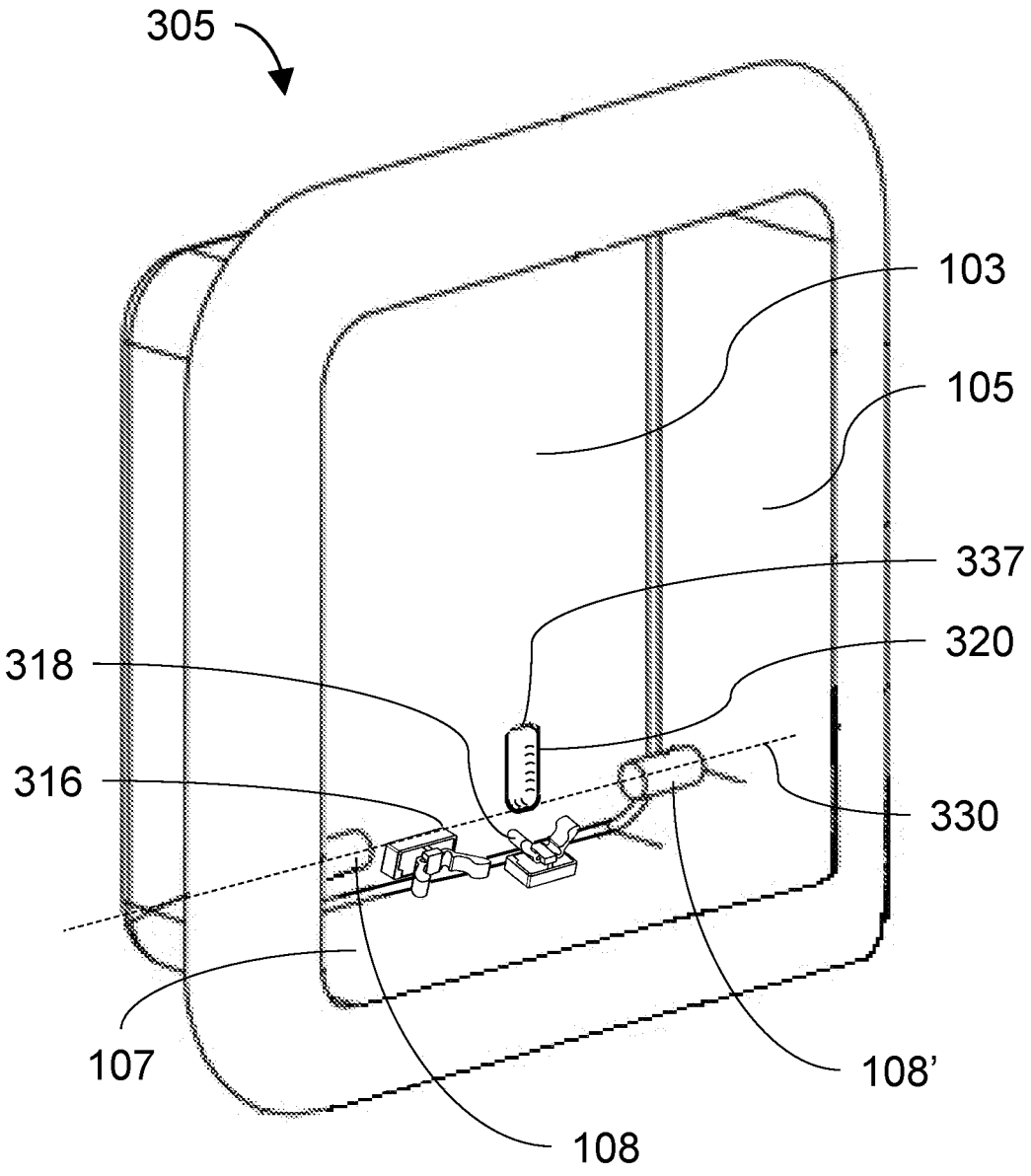
FIG. 3C illustrates the push-to-open recessed soap case of the push-to-open shower wall upright soap holder.

FIG. 3C illustrates the push-to-open recessed soap case 305 that has the same features as the recessed soap case 106 and some additional elements, namely a tray push-to-open latch 316 mounted in the soap case back 103, a holster push-to-open latch 318 mounted on the bottom surface 107, and a recess 320. The tray push-to-open latch 316 can have the body submerged in the soap case back 103. The tray push-to-open latch 316 may extend out the back of the push-to-open recessed soap case 305 or may be contained in it. The tray push-to-open latch 316 may be mounted near the bottom, so that the clasp arms 203 and 204 can be engaged by the push-to-open drip tray 315. Positioned next to the tray push-to-open latch 316 but mounted at the bottom surface 107 is the holster push-to-open latch 318. The tray push-to-open latch 316 and the holster push-to-open latch 318 need to be positioned such that they both can be engaged without interfering with each other during operation, for example the tray push-to-open latch 316 can be offset to the left and the holster push-to-open latch 318 can be offset to the right. Also located aligned to the holster push-to-open latch 318 on the soap case back 103 is the recess 320, that is shaped like a vertical trench on the soap case back 103, starting at the bottom aligned to the push-to-open latch 318 and running upward ending at a top edge 337.

Figure 3D:
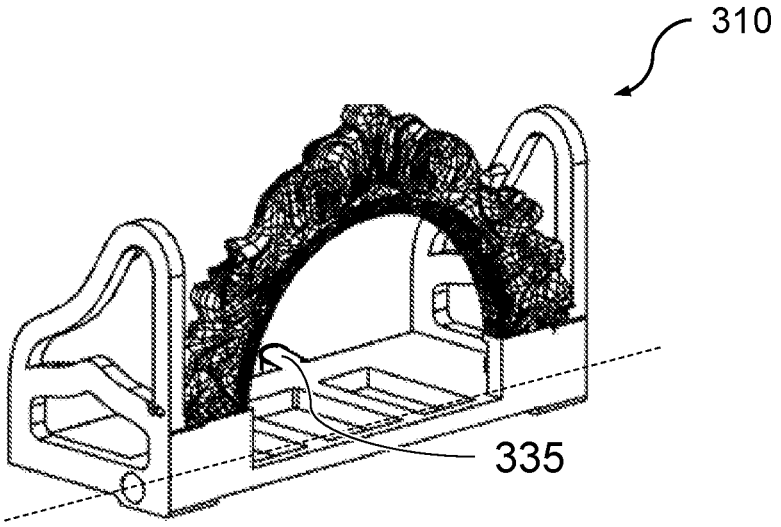
FIG. 3D illustrates a push-to-open collapsible soap holster of the push-to-open shower wall upright soap holder.

FIG. 3D illustrates the push-to-open collapsible soap holster 310 that has all the features described for the collapsible soap holster 110 with the addition of a holster latch engagement arm 335.

Figure 3E:
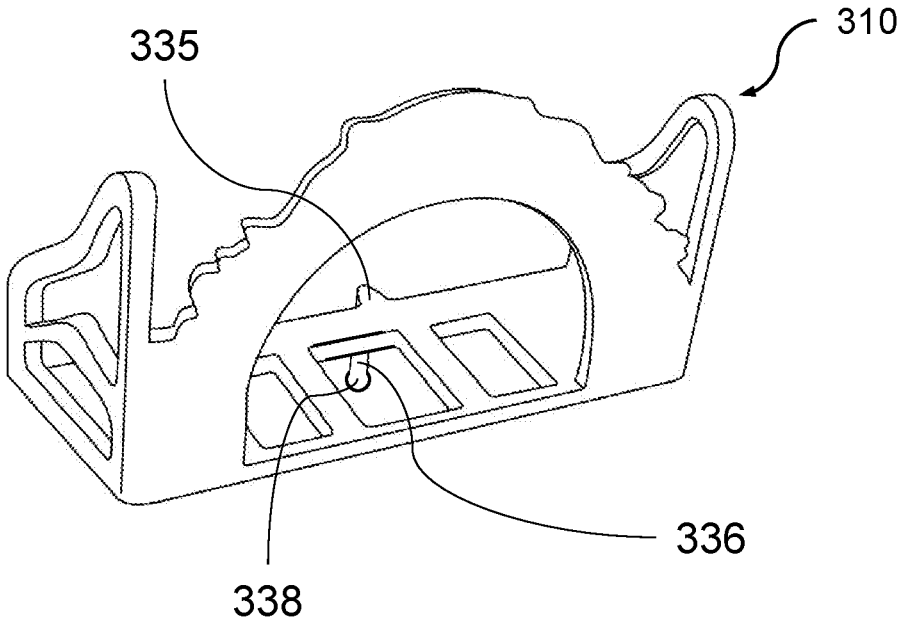
FIG. 3E illustrates the push-to-open collapsible soap holster showing the holster latch engagement parts.

FIG. 3E show the push-to-open collapsible soap holster 310 with more detail of the holster latch engagement arm 335 visible. The holster latch engagement arm 335 has a holster latch engagement neck 336 and a holster latch engagement bulb 338. The holster latch engagement bulb 338 can engage the holster push-to-open latch 318, when the push-to-open shower wall upright soap holder 300 is in a closed holster configuration.

Figure 3F:
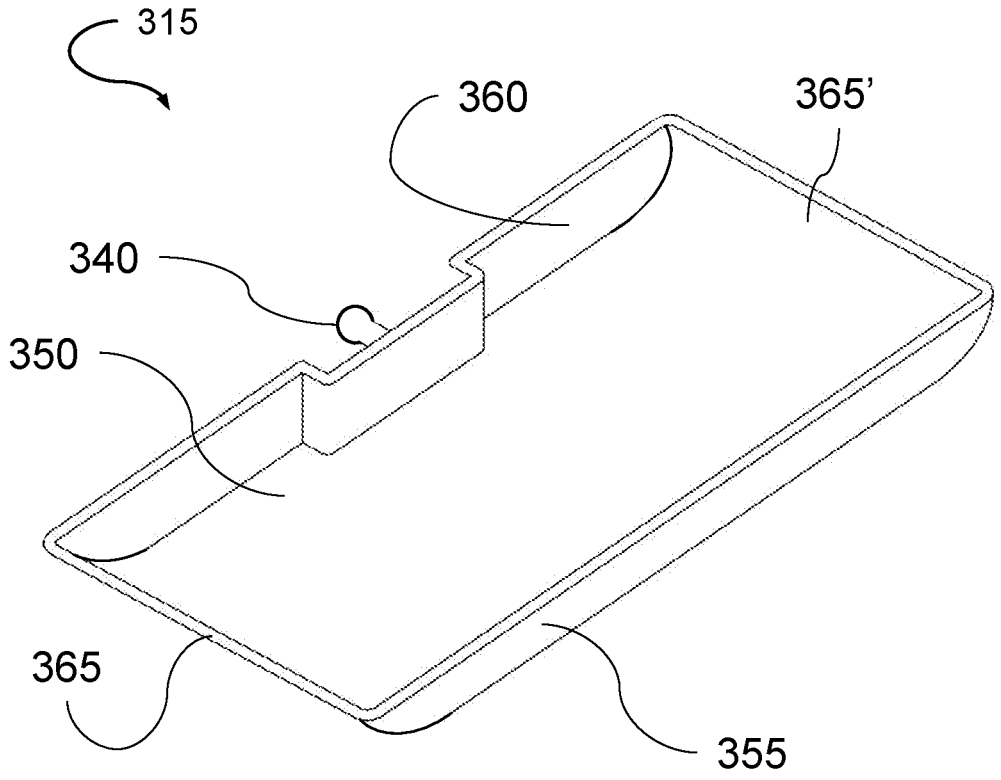
FIG. 3F illustrates a push-to-open drip tray of the push-to-open shower wall upright soap holder

FIG. 3F illustrates the push-to-open drip tray 315 that has a tray latch engagement arm 340 that engages with the tray push-to-open latch 316, a tray bottom 350, a tray front 355, a tray back 360, and tray sides 365 and 365'. The push-to-open drip tray 315 may be removed for cleaning the captured soap water drippings.

Figure 3G:
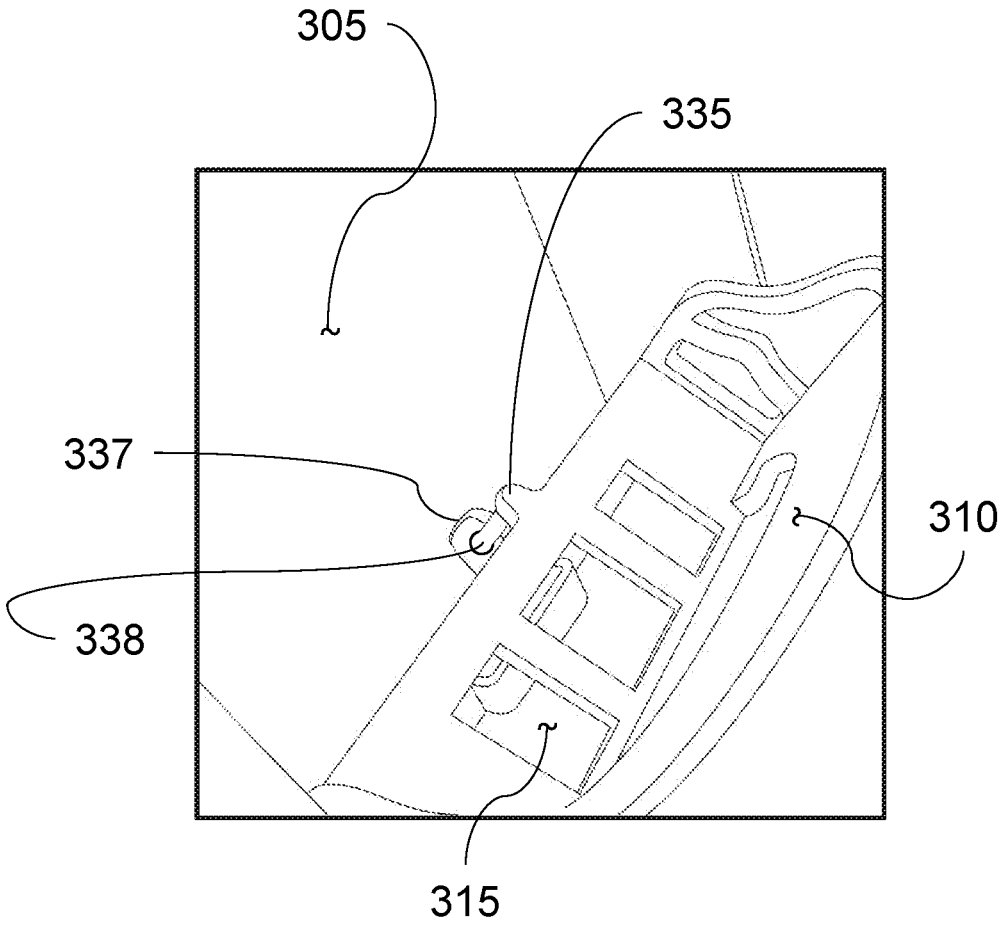
FIG. 3G illustrates a close-up of the push-to-open shower wall upright soap holder transitioning to the holster configuration.

FIG. 3G illustrates a close-up of the push-to-open collapsible soap holster 310 transitioning from the closed holster configuration to the open holster configuration. The illustration shows the push-to-open recessed soap case 305 on the left, the push-to-open collapsible soap holster 310 on the right pivoting with the holster latch engagement arm 335, —specifically the holster latch engagement bulb 338— swinging through the recess 320. Also shown under the push-to-open collapsible soap holster 310 is the push-to-open drip tray 315. The holster latch engagement arm 335 is swinging through the recess 320 and the push-to-open shower wall upright soap holder 300 may be dimensioned so that further tipping of the push-to-open collapsible soap holster 310 is restricted by the top edge 337 of the recess 320 restricting further movement of the holster latch engagement arm 335. Thus, the pivot of the push-to-open collapsible soap holster 310 may be restricted to not move beyond a predefined angle in an open holster configuration by the holster latch engagement arm 335.

Figure 4:
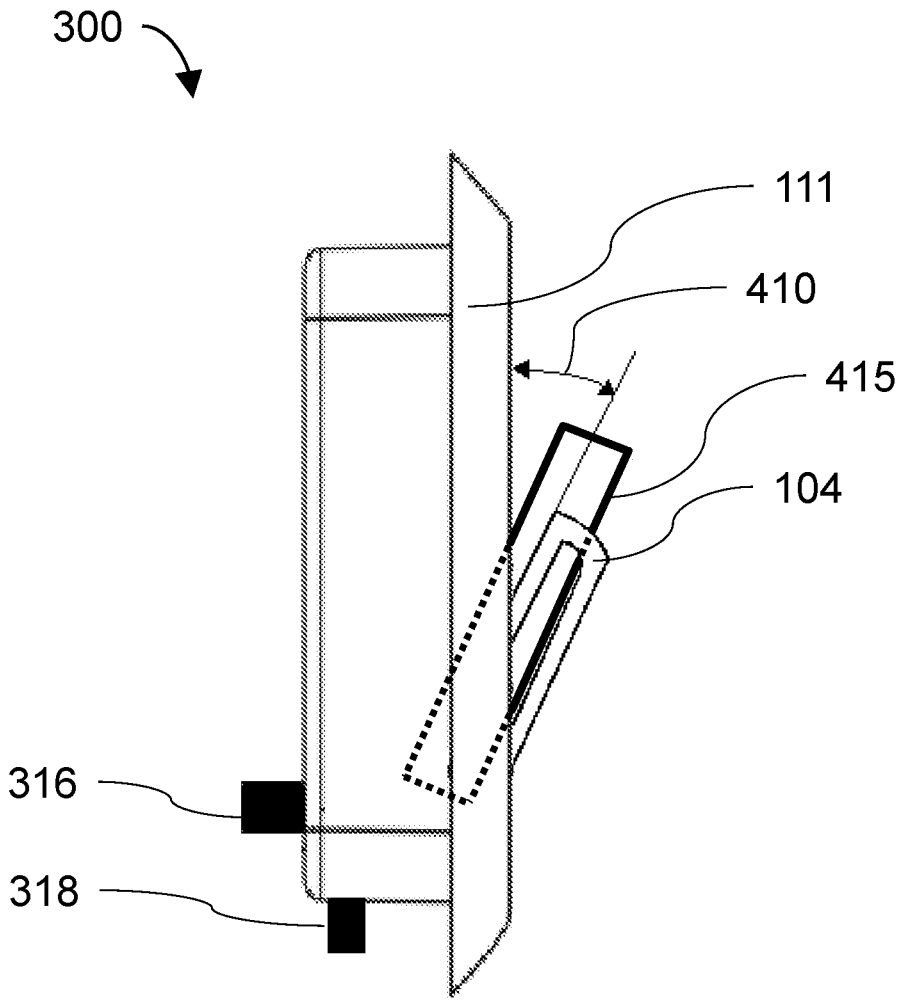
FIG. 4 illustrates a side view of the assembly of the push-to-open shower wall upright soap holder in the open holster configuration with a bar of soap.

FIG. 4 illustrates a side view of the push-to-open shower wall upright soap holder 300 in the open holster configuration. The push-to-open shower wall upright soap holder 300 may be in the open holster configuration or the closed holster configuration. In the open holster configuration, the front bracket 104 is at a predefined angle 410 from the front rim 111. The predefined angle may be between 30 to 60 degrees, for example 30 degrees. The open holster configuration allows a user to place a bar of soap 415 in a collapsible soap holster 110.

Figure 5:
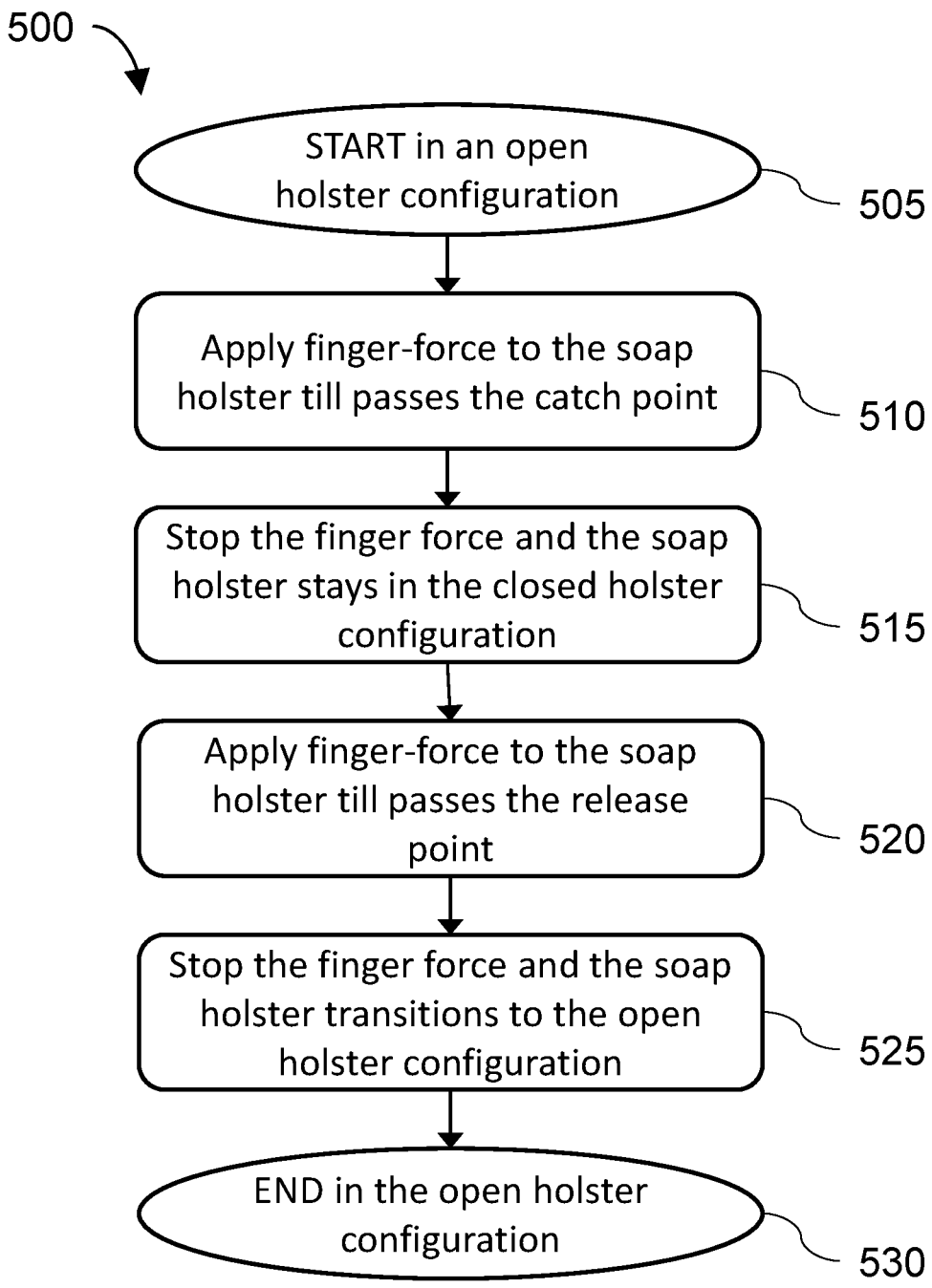
FIG. 5 shows a flow chart of a method of operating the push-to-open collapsible soap holster from the closed holster configuration to an open holster configuration and back to the closed holster configuration.

FIG. 5 shows a flow chart 500 for operating the push-to-open collapsible soap holster 310. The push-to-open collapsible soap holster 310 can change from the open holster configuration to the closed holster configuration by application of finger-force on the front bracket 104.

The flow chart 500 starts at oval 505 with the push-to-open collapsible soap holster 310 in the open holster configuration.

At box 510, the front of the push-to-open collapsible soap holster 310 is pushed and moves the push-to-open collapsible soap holster 310 inward past a catch position. Application of finger-force causes angular motion of the push-to-open collapsible soap holster 310 on the soap holder rotation axis 330 such that the push-to-open collapsible soap holster 310 engages with the holster push-to-open latch 318. After the push-to-open collapsible soap holster 310 is engaged with the holster push-to-open latch 318, application of finger-force may be stopped.

Next, at box 515, the finger-force is stopped. The push-to-open collapsible soap holster 310 remains in a closed holster configuration, securing the push-to-open collapsible soap holster 310 inside the push-to-open recessed soap case 305 and accommodating the standing bar of soap 415. In the closed holster configuration, the holster bottom may be substantially parallel to the inside bottom surface of push to open recessed soap case 305.

Immediately after the finger force is stopped the push-to-open collapsible soap holster 310 may move outward to a closed holster configuration. Alternatively, once past the catch position the push-to-open collapsible soap holster 310 may already be in the closed holster configuration. Staying in the closed holster configuration can be achieved in a number of ways, for example stopping the pushing on the front of the push-to-open collapsible soap holster 310 may happen after the holster latch engagement arm 335 has engaged with the holster push-to-open latch 318 which has been pushed past the catch point. When the finger-force was applied on the front bracket 104 that caused the push-to-open collapsible soap holster 310 to rotate in an angular motion on the soap holder rotation axis 330 till the holster latch engagement arm 335 engaged with the holster push-to-open latch 318. After push-to-open collapsible soap holster 310 is engaged with the holster push-to-open latch 318, the push-to-open collapsible soap holster 310 can remain in the closed holster configuration.

Next at box 520, the front of the push-to-open collapsible soap holster 310 is pushed again to initiate the transition of the push-to-open collapsible soap holster 310 to the open holster configuration. This transition could be accomplished in a number of ways for example by use of the holster push-to-open latch 318 being pushed past the release point.

Next at box 525 the push is stopped when the push-to-open collapsible soap holster 310 is past the release point. Then the push-to-open collapsible soap holster 310 may transition from the closed holster configuration to the open holster configuration. The push-to-open collapsible soap holster 310 may transition to the open holster configuration by rotating on the soap holder rotation axis 330. The transition may occur due to a biasing force. The biasing force may come from a biasing spring, the spring may be located in the holster push-to-open latch 318. Gravity may apply the biasing force once the push-to-open collapsible soap holster 310 is past a tipping point. Biasing force may come from a separate biasing spring attached to the push-to-open collapsible soap holster 310. Alternatively, other mechanisms may be used to pivot the push-to-open collapsible soap holster 310 to the open holster configuration. In the open holster configuration, the holster latch engagement arm 335, may be disengaged from a holster push-to-open latch 318.

The rotation of the push-to-open collapsible soap holster 310 may stop because the holster latch engagement arm 335 has run into the front top edge 345 of the recess 320. Alternatively, with the push-to-open drip tray 315 in the closed configuration the gap between the front top edge 345 of the push-to-open drip tray 315 and the push-to-open collapsible soap holster 310 may go to zero and stop the rotation of the collapsible soap holster at the predefined angle.

Finally, at oval 530 the flow chart 500 ends.

Figure 6:
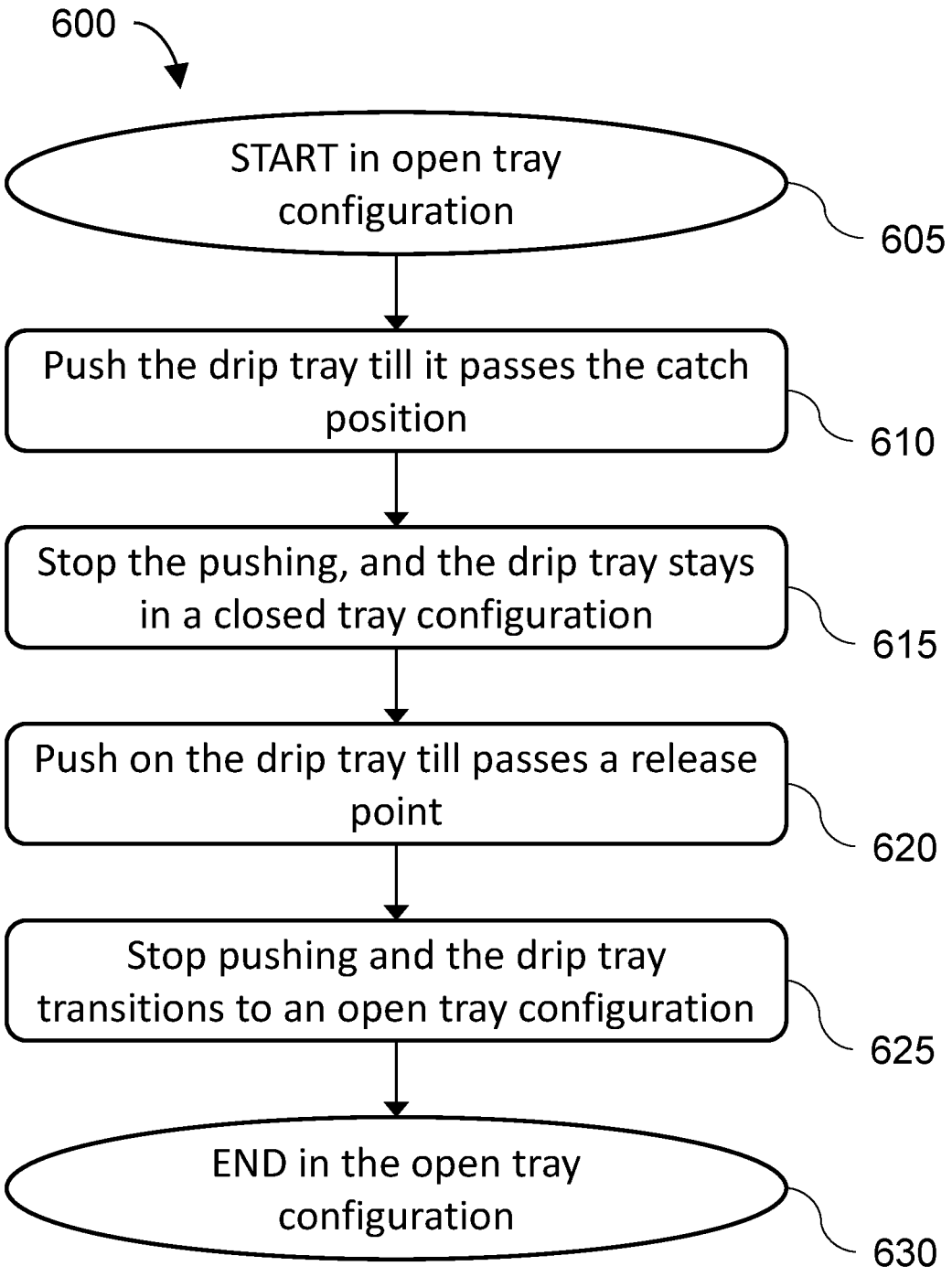
FIG. 6 shows a flow chart of a method of operating the push-to-open drip tray on the shower wall upright soap holder from the closed drip tray configuration to an open tray configuration and back to the closed drip tray configuration.

FIG. 6 illustrates a flow chart 600 of a method for operating the push-to-open drip tray 315. The flow chart 600 starts at oval 605 with the push-to-open shower wall upright soap holder 300 in the open tray configuration.

Next at box 610, with the push-to-open drip tray 315 resting on the inside bottom surface 107 the tray front 355 is pushed inward with a finger-force. The push-to-open drip tray 315 may slide from an open tray configuration to a closed tray position. When the push-to-open drip tray 315 is pushed passed a catch point then upon releasing of the finger-force of the push-to-open drip tray 315 may stay in a closed tray configuration.

Next at box 615, pushing is stopped when the push-to-open drip tray 315 is past the catch position. Past the catch position, the push-to-open drip tray 315 stays in the closed tray configuration. For example, the push-to-open drip tray 315 is pushed till the tray latch engagement arm 340 is engaged with the tray push-to-open latch 316. The push-to-open drip tray 315 remains in the closed tray configuration till the tray latch engagement arm 340 remains engaged with the tray push-to-open latch 316.

Next at box 620, with the push-to-open drip tray 315 in the closed tray configuration. In the closed tray configuration, the tray latch engagement arm 340 is releasably engaged with a tray push-to-open latch 316. For example, the tray latch engagement arm 340 is engaged with the tray push-to-open latch 316.

Next at box 625, the push-to-open drip tray 315 transitions to the open tray configuration. The push-to-open latch may slide the push-to-open drip tray forward due to a biasing force exerted by the push-to-open latch. In the open tray configuration, the tray latch engagement arm 340 is disengaged from the tray push-to-open latch 316. The push-to-open drip tray 315 is then free to slide forward and the push-to-open drip tray 315 may be removed.

Thereafter, the flow chart 600 ends at oval 630.

The shower wall upright soap holder may be integral to a pre-formed shower unit, with the recessed soap case being integral to a wall of a pre-formed shower unit. The pre-formed shower unit may be used in original builder home construction or in homeowner remodels.

While preferred materials for elements have been described, the device is not limited by these materials. Wood, plastics, rubber, foam, metal alloys, aluminum, stone and other materials may comprise some or all of the elements of the soap hosting dish/case positioning devices and apparatuses in various embodiments of the present invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A shower wall upright soap holder comprising:

a recessed soap case, wherein the recessed soap case is capable of going into a wall, wherein the recessed soap case has an inside back surface, an inside top surface, an inside right surface, an inside bottom surface, an inside left surface, and a holster push-to-open latch;

a collapsible soap holster, wherein the collapsible soap holster is capable of holding a soap inside the recessed soap case, wherein the collapsible soap holster has a front bracket, a holster bottom and side holster surfaces, wherein the front bracket and the holster bottom of the collapsible soap holster have one or more openings for air circulation, wherein the collapsible soap holster switches from a closed holster configuration to an open holster configuration triggered by application of finger-force on the front bracket pushing toward the inside back surface and collapsible soap holster switches from the open holster configuration to the closed holster configuration by application on the front bracket of a finger-force pushing towards the inside back surface till the collapsible soap holster engages with the holster push-to-open latch; and a drip tray, wherein the drip tray has a tray bottom, a tray front, a tray back, and tray sides, wherein the drip tray is capable of being, positioned under the collapsible soap holster such that water dripping from the soap is captured in the drip tray.

2. The shower wall upright soap holder as claimed in claim 1, wherein in the closed holster configuration the holster bottom is substantially parallel to the inside bottom surface and the front bracket is substantially parallel to the inside back surface and in the open holster configuration the holster bottom is at a predefined angle from the inside bottom surface and the front bracket is at the predefined angle to the inside back surface.

3. The shower wall upright soap holder as claimed in claim 1, wherein the drip tray is capable of sliding from an open tray configuration to a closed tray position by application on the tray front a push force directed towards the inside back surface and the drip tray is capable of sliding from the close tray position to the open tray configuration by application of push force on the tray front towards the inside back surface of the drip tray followed by pull force.

4. The shower wall upright soap holder as claimed in claim 1 further comprising a holster elongated lockable member, wherein the holster elongated lockable member is located under the bottom holster surface, wherein the holster push-to-open latch is located at the inside bottom surface of the recessed soap case, wherein the holster elongated lockable member is releasably engaged with the holster push-to-open latch in the closed holster configuration, wherein the holster elongated lockable member is disengaged from the holster push-to-open latch in the open holster configuration.

5. The shower wall upright soap holder as claimed in claim 1 further comprising a tray latch engagement arm and a tray push-to-open latch, wherein the tray latch engagement arm is located at the back of the tray back protruding towards the inside back surface of the recessed soap case, wherein the tray push-to-open latch is located at the inside back surface of the recessed soap case, wherein the tray latch engagement arm is releasably engaged with the tray push-to-open latch in the closed holster configuration, wherein the tray latch engagement arm is disengaged from the tray push-to-open latch in the open holster configuration.

6. The shower wall upright soap holder as claimed in claim 1, wherein the collapsible soap holster has a pair of coaxial pins protruding towards the inside left surface and the inside right surface of the recessed soap case, wherein the inside left surface and the inside right surface of the recessed soap case has a pair of coaxial holes, wherein the pair of coaxial pins is capable of rotating inside the pair of coaxial holes enabling angular motion of the collapsible soap holster between the closed holster configuration and the open holster configuration, wherein the pair of coaxial pins and the pair of coaxial holes are defined by a holster rotation axis.

7. The shower wall upright soap holder as claimed in claim 1, wherein the collapsible soap holster has a pair of coaxial holes on the inside left surface and the inside right surface of the recessed soap case, wherein the inside left surface and the inside right surface of the recessed soap case has a pair of coaxial pins, wherein the pair of coaxial pins is capable of rotating inside the pair of coaxial holes enabling angular motion of the collapsible soap holster between the closed holster configuration and the open holster configuration, wherein the pair of coaxial pins and the pair of coaxial holes are defined by a holster rotation axis.

8. The shower wall upright soap holder as claimed in claim 1, wherein the one or more openings covers more than 40% of the bottom holster surface.

9. A shower wall upright soap holder comprising:

a recessed soap case, wherein the recessed soap case is capable of going into a wall, wherein the recessed soap case has an inside back surface, an inside top surface, an inside right surface, an inside bottom surface, and an inside left surface;

a holster push-to-open latch; and a collapsible soap holster, wherein the collapsible soap holster is capable of holding a soap inside the recessed soap case, wherein the collapsible soap holster has a front bracket, a holster bottom and side holster surfaces, wherein the front bracket has one or more openings for air circulation, wherein the holster bottom of the collapsible soap holster has one or more openings for air circulation, wherein the collapsible soap holster switches from a closed holster configuration to an open holster configuration triggered, by application of finger-force on the front bracket pushing toward the inside back surface and collapsible soap holster switches from the open holster configuration to the closed holster configuration by application on the front bracket of a finger-force pushing towards the inside back surface till the collapsible soap holster and the the holster push-to-open latch engage.

10. The shower wall upright soap holder as claimed in claim 9 wherein the holster bottom is substantially parallel to the inside bottom surface and the front bracket is parallel to the inside back surface in the closed holster configuration, wherein the holster bottom is at a predefined angle to the inside bottom surface and the front bracket is at the predefined angle to the inside back surface in the open holster configuration.

11. The shower wall upright soap holder as claimed in claim 9 further comprising a drip tray, the drip tray has a tray bottom, a tray front, a tray back, and tray sides, wherein the drip tray is capable of being positioned under the collapsible soap holster such that water dripping from the soap is captured in the drip tray, wherein the drip tray can slide from an open tray configuration to a closed tray position by application on the tray front a push force directed towards the tray back and the drip tray is capable of sliding from the close tray position to the open tray configuration by application of push force on the tray front towards the tray back of the drip tray followed by a pull force.

12. The shower wall upright soap holder as claimed in claim 9, wherein the drip tray further comprising a tray latch engagement arm and a tray push-to-open latch, wherein the tray latch engagement arm is located at the back of the tray back protruding towards the inside back surface of the recessed soap case, wherein the tray push-to-open latch is located at the inside back surface of the recessed soap case, wherein the tray latch engagement arm is releasably engaged with the tray push-to-open latch in the closed holster configuration, wherein the tray latch engagement arm is disengaged from the tray push-to-open latch in the open holster configuration.

13. The shower wall upright soap holder as claimed in claim 9 further comprising a holster elongated lockable member, wherein the holster elongated lockable member is located under the bottom holster surface, wherein the holster push-to-open latch is located at the inside bottom surface of the recessed soap case, wherein the holster elongated lockable member is releasably engaged with the holster push-to-open latch in the closed holster configuration, wherein the holster elongated lockable member is disengaged from the holster push-to-open latch in the open holster configuration.

14. The shower wall upright soap holder as claimed in claim 9, wherein the drip tray rests on top of the inside bottom surface of the recessed soap case.

15. The shower wall upright soap holder as claimed in claim 9, wherein the one or more openings covers more than 40% of the bottom holster surface.

16. The shower wall upright soap holder as claimed in claim 9, wherein the collapsible soap holster has a pair of coaxial pins protruding towards the inside left surface and the inside right surface of the recessed soap case, wherein the inside left surface and the inside right surface of the recessed soap case has a pair of co axial holes, wherein the pair of coaxial pins is capable of rotating inside the pair of co axial holes enabling angular motion of the collapsible soap holster between the closed holster configuration and the open holster configuration, wherein the pair of coaxial pins and the pair of coaxial holes are defined by a holster rotation axis.

17. A method of operating a shower wall uptight soap holder, wherein the shower wall upright soap holder has a recessed soap case and a collapsible soap holster where the collapsible soap holster has a front the method comprising:

pushing on the front of the collapsible soap holster when the collapsible soap holster is in an open holster configuration to transition the collapsible soap holster from the open holster configuration to a catch position that puts the collapsible soap holster in a closed holster configuration;

stopping the pushing on the front of the collapsible soap holster with the collapsible soap holster past a catch position and the collapsible soap holster stays in the closed holster configuration;

pushing on the front of the collapsible soap holster when the collapsible soap holster is in the closed holster configuration till the collapsible soap holster is past a release point; and stopping the pushing on the front of the collapsible soap holster when the collapsible soap holster is past the release point, and then the collapsible soap holster transitions from the closed holster configuration to the open holster configuration.

18. The method of operating the shower wall upright soap holder as claimed in claim 17, wherein stopping the pushing on the front of the collapsible soap holster further comprising releasably engaging a holster elongated lockable member of the collapsible soap holster with a holster push-to-open latch that is in a closed holster configuration.

19. The method of operating the shower wall upright soap holder in claim 17 where the shower wall upright soap holder also includes a drip tray, the method further comprising operating a drip tray of the shower wall upright soap holder, the method comprising:

pushing on a tray front of a drip tray when the drip tray is in an open tray configuration to transition the drip tray from the open tray configuration to a catch position that put the drip tray in a closed tray configuration;

stopping the pushing on the tray front and the drip tray stays in the closed tray configuration;

pushing on the tray front of the drip tray when the drip tray is in the closed tray configuration till the drip tray is past a release point; and stopping the pushing on the drip tray to transition the drip tray from the closed tray configuration to the open tray configuration.

20. The method of operating a collapsible soap holster as claimed in claim 19, wherein pushing on the tray front of the drip tray further comprising disengaging a tray latch engagement arm from a tray push-to-open latch in the open holster configuration.

* * * * *